US009038321B2

(12) United States Patent
Leuchten

(10) Patent No.: US 9,038,321 B2
(45) Date of Patent: May 26, 2015

(54) PAINT MIXING ROOM

(75) Inventor: Thomas Leuchten, Duesseldorf (DE)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 14/113,968

(22) PCT Filed: Apr. 24, 2012

(86) PCT No.: PCT/EP2012/001747

§ 371 (c)(1),
(2), (4) Date: Jan. 14, 2014

(87) PCT Pub. No.: WO2012/146366

PCT Pub. Date: Nov. 1, 2012

(65) Prior Publication Data

US 2014/0130423 A1 May 15, 2014

(30) Foreign Application Priority Data

Apr. 26, 2011 (DE) ..... 10 2011 018 706

(51) Int. Cl.

| | |
|---|---|
| ***E04B 1/343*** | (2006.01) |
| ***E04H 1/12*** | (2006.01) |
| ***E04H 3/04*** | (2006.01) |

(52) U.S. Cl.

CPC ..... *E04B 1/34336* (2013.01); *E04H 1/12* (2013.01); *E04H 3/04* (2013.01); *E04B 1/34357* (2013.01)

(58) Field of Classification Search

CPC ... E04B 1/34357; E04B 1/34336; E04H 3/04; E04H 1/12

USPC ..... 52/79.1, 79.5, 79.9, 79.13, 143, 64–65, 52/67, 69, 71; 296/24.32, 24.3

See application file for complete search history.

(56) References Cited

U.S. PATENT DOCUMENTS

| | | | | | |
|---|---|---|---|---|---|
| 1,989,940 | A | * | 2/1935 | McGaughan et al. | 280/80.1 |
| 3,258,019 | A | * | 6/1966 | Bellas et al. | 134/99.2 |
| 3,308,845 | A | * | 3/1967 | Bellas et al. | 137/234.6 |
| 3,584,911 | A | * | 6/1971 | Coletto, Jr. | 296/24.3 |
| 4,377,367 | A | * | 3/1983 | Smith | 414/545 |
| 4,478,467 | A | * | 10/1984 | Tyndall | 312/249.9 |
| 4,841,897 | A | * | 6/1989 | Claflin | 114/344 |
| 5,193,325 | A | * | 3/1993 | Allison | 52/745.02 |
| 5,383,703 | A | * | 1/1995 | Irvine, III | 296/24.45 |
| 5,493,840 | A | * | 2/1996 | Cane | 53/50 |
| 5,533,305 | A | * | 7/1996 | Bielecki | 52/79.1 |
| 5,661,930 | A | * | 9/1997 | Porter | 52/64 |
| 5,853,215 | A | * | 12/1998 | Lowery | 296/24.32 |
| 5,864,991 | A | | 2/1999 | Burns | |
| 6,539,325 | B1 | * | 3/2003 | Numata et al. | 702/127 |

(Continued)

FOREIGN PATENT DOCUMENTS

| | | | |
|---|---|---|---|
| DE | 1752231 | A1 | 5/1971 |
| EP | 1983118 | A2 | 10/2008 |

*Primary Examiner* — Beth Stephan

(74) *Attorney, Agent, or Firm* — Charles M. Yeomans; Alan C. Towner

(57) ABSTRACT

The invention relates to a paint mixing room (1) comprising a base portion (2), four walls (3), a top portion (4) and at least one door (5) located in one the walls (3); at least one shelf (6), particularly for water-borne products, solvent-borne products and/or color tools; at least one workbench (7); a color station (8) comprising e.g. a personal computer, a spectrophotometer, and a barcode reader; a connector for an electrical power supply; and a ventilation system (11); wherein the paint mixing room (1) is portable.

8 Claims, 1 Drawing Sheet

(56) References Cited

U.S. PATENT DOCUMENTS

| | | | | |
|---|---|---|---|---|
| 6,637,471 | B2 * | 10/2003 | Luehrsen et al. | 141/83 |
| 6,817,653 | B2 * | 11/2004 | Ropp | 296/186.2 |
| 6,969,102 | B2 * | 11/2005 | Orischak et al. | 296/24.32 |
| 2004/0140683 | A1 * | 7/2004 | Orischak et al. | 296/24.32 |
| 2005/0179276 | A1 * | 8/2005 | Morello | 296/24.32 |
| 2005/0275842 | A1 * | 12/2005 | Simons et al. | 356/402 |
| 2006/0076080 | A1 * | 4/2006 | Salas | 141/104 |
| 2007/0056510 | A1 * | 3/2007 | Antaya | 118/326 |
| 2007/0182182 | A1 * | 8/2007 | Hall | 296/24.32 |
| 2008/0305241 | A1 * | 12/2008 | Trevino et al. | 427/1 |
| 2009/0248199 | A1 * | 10/2009 | Milhorn | 700/239 |
| 2009/0310856 | A1 * | 12/2009 | Korenkiewicz et al. | 382/165 |

* cited by examiner

PAINT MIXING ROOM

FIELD OF THE INVENTION

The invention relates to a paint mixing room comprising a base portion, four walls, a top portion, and at least one door located in one of the walls; at least one shelf, particularly for water-borne products, solvent-borne products with mixing heads and paddles and/or color tools; at least one workbench; a color station comprising e.g. a personal computer, a spectrophotometer, and a barcode reader; a connector for an electrical power supply; and a ventilation system. The at least one shelf, the at least one workbench and the color station are advantageously located inside the paint mixing room.

BACKGROUND

Paints, e.g. for painting a car, must be mixed and prepared before they are applied to the work piece to be painted. Due to evaporation of the paint during mixing and preparation, the air is polluted by vapors. In many countries, federal regulations are in force with respect to paint mixing rooms to protect persons working in a paint mixing room against hazards caused by paint vapors. This federal regulation e.g. relate to the ventilation and fire safety of a paint mixing room. Furthermore, paint mixing rooms must be explosion-proof.

In case a paint manufacturer wants to present new paint products and/or painting equipment at customers, the demonstration often takes place in a corner away from the existing mixing room due to space issues. In such an environment, it is impossible to present the paint products and/or the painting equipment in an optimal way, especially to demonstrate real value.

To overcome these issues, applicant has previously developed a demonstration van to present paint products and painting equipment to customers. In such a way, the paint product and the painting equipment can be presented in a professional environment, but it is temporarily and does not show what is possible in relation to a real paint mixing room. Furthermore, the available space in such a modified van is very limited and the whole van can swing in case a person is moving inside the van.

It is thus an object of the present invention to provide an environment in which paint products and/or painting equipment can be presented to the customers in an optimal way, especially which allows to demonstrate real value.

SUMMARY

The problem is solved by a paint mixing room comprising a base portion; four walls; a top portion; and a least one door located in one of the walls; at least one shelf, particularly for water-borne products, solvent-borne products with mixing heads and paddles and/or color tools; at least one workbench; a color station comprising e.g. a personal computer, a spectrophotometer and a barcode reader; a connector for an electrical power supply; and a ventilation system, wherein the paint mixing room is portable. The at least one shelf, the at least one workbench and the color station are advantageously located inside the paint mixing room. Preferably the paint mixing room is fully self-contained and fulfills all regulations with respect to ventilation, fire-safety and stability.

The paint mixing room is portable in the sense of this invention in case it can be moved by a transport vehicle or a trailer.

A fully self-contained paint mixing room in the sense of the invention is a paint mixing room containing all necessary equipment to produce a paint for painting a work piece, and the paint mixing room fulfills all regulations with respect to ventilation, fire-safety and stability in case a person is allowed to work inside the paint mixing room over a long period.

The paint mixing room according to the invention has the advantage that it can be equipped at the producer with all necessary items to present a showroom/mixing room to a customer and present real value. The fully equipped self-contained paint mixing room can be transported to a customer where it can be e.g. placed in a body shop, where the showroom/mixing room can be present to the customer in an optimal way.

According to a variant of the invention, the paint mixing room is built and sized in such a way that it can be transported via a trailer. In this room the paint mixing room can be easily transported to a customer.

According to a further variant of the invention, the paint mixing room is at most 6 m long, 4 m wide and 3 m high, preferably 3 m long, 2 m wide and 2.5 m high. A paint mixing room with these dimensions can be e.g. transported via trailer and placed into a body shop at the customer.

In a further variant, the paint mixing room further comprises at least two recesses in the base portion which are configured in such a way that the paint mixing room can be moved by a fork lift. In this way, the paint mixing room can be e.g. placed in a body shop via a fork lift.

In a further variant, the paint mixing room comprises at least two wheels, preferably four wheels, at the base portion. A paint mixing room with at least two wheels, preferably four wheels, can be wheeled around at the customer e.g. wheeled into a body shop. Preferably, the wheels have a diameter less than 10 cm and consists of a hard material, e.g. plastic.

According to a preferred variant, the at least two wheels, preferably four wheels, are retractable. Hence, the wheels can be retracted once the paint mixing room has been moved to its final destination. This has the advantage that the paint mixing room is stable during its use. Alternatively, some of the wheels comprise a brake.

In a further variant, the paint mixing room comprises connecting means for connecting the paint mixing room to a crane, preferably located at the top portion. Using these connecting means the paint mixing room can be moved at the customer via a crane.

According to a preferred variant, one of the sidewalls of the paint mixing room, preferably the sidewall comprising the door, comprises at least one window. Preferably, at least 50% of the surface area of the sidewall consists of window glass. Hence, more light from outside can shine into the paint mixing room and persons can look from outside into the paint mixing room e.g. during a presentation.

Advantageously, the paint mixing room is fully constructed and equipped prior to delivery. Thus, the paint mixing room can be used for a presentation directly after it has been transported to a customer.

According to a further preferred variant of the invention, the outside walls of the paint mixing room further comprise a shelf, a work table, at least one scale and/or a personal computer. Hence, outside the painting mixing rooms are working stations which can also be used during the presentation in case the used products do not have to be handled inside a paint mixing room due to safety regulations.

According to a further variant of the invention, at least one of the four walls is moveable relative to the other walls to extend the working space inside the paint mixing room.

BRIEF DESCRIPTION OF THE DRAWINGS

In the following, an embodiment of the invention will be described with reference to the accompanying figures.

DETAILED DESCRIPTION

Figure 1:
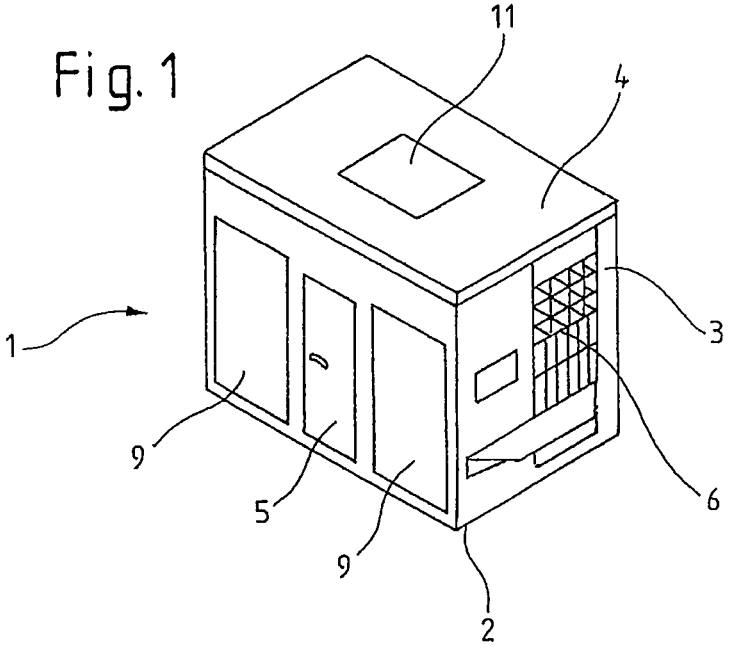
FIG. 1 shows a perspective view of a paint mixing room according to an embodiment of the invention.

FIG. 1 shows a painting mixing room 1 comprising a base portion 2, four walls 3, a top portion 4, and at least one door 5 located in one the walls 3; at least one shelf, particularly for water-borne products, solvent-borne products with mixing heads and paddles and/or color tools; at least one workbench 7; a color station 8 comprising e.g. a personal computer, a spectrophotometer, and a barcode reader; a connector for an electrical power supply; and a ventilation system; wherein the paint mixing room 1 is portable.

The paint mixing room 1 is fully constructed prior to delivery rather than pre-fabricated and requiting assembly at the customer. The fully self-contained paint mixing room 1 fulfills all regulations with respect to ventilation, fire-safety and stability.

After the paint mixing room 1 has been transported to a customer, where products will be presented, the paint mixing room 1 only has to be connected to a power supply and is ready for use. The paint mixing room 1 can be used to present products in an optimal way and to demonstrate real value.

The paint mixing room 1 is built and sized in such a way that it can be transported via a trailer. The paint mixing room 1 according to FIG. 1 is 3 m long, 2 m wide and 2.8 m high. Thus, the paint mixing room 1 can be easily transported to a customer.

The base portion 2 of the paint mixing room 1 comprises two recesses (not shown) which are configured in such a way that the paint mixing room 1 can be moved by a fork lift.

The base portion 2 further comprises four wheels (not shown) which are retractable. The paint mixing room 1 can be moved into its final position at the customer via these wheels. After the paint mixing room 1 has reached its final destination, the wheels are retracted and the base portion 2 of the paint mixing room 1 rests on the ground floor.

The sidewall 3 comprising the door 5 as well as the door 5 itself comprise windows 9. More than 50% of the surface area of the sidewall 3 and the door 5 consists of window glass. Hence, one can look inside the paint mixing room during a presentation so that during a presentation of products only one person should be inside the paint mixing room 1 while the others watch the presentation from outside.

Two outside walls 4 of the paint mixing room 1, each comprising a shelf 6, a workbench 7, at least one scale which can be placed inside the shelf 6, and/or a personal computer which can be integrated into the sidewall 4 and then used via a touch pad display.

Preferably, at least one of the four walls 3 is moveable relative to the other walls 3 to extend the working space inside the paint mixing room 1. Hence, the paint mixing room 1 can be extended after it has been transported to a customer and moved to its final destination.

Figure 2:
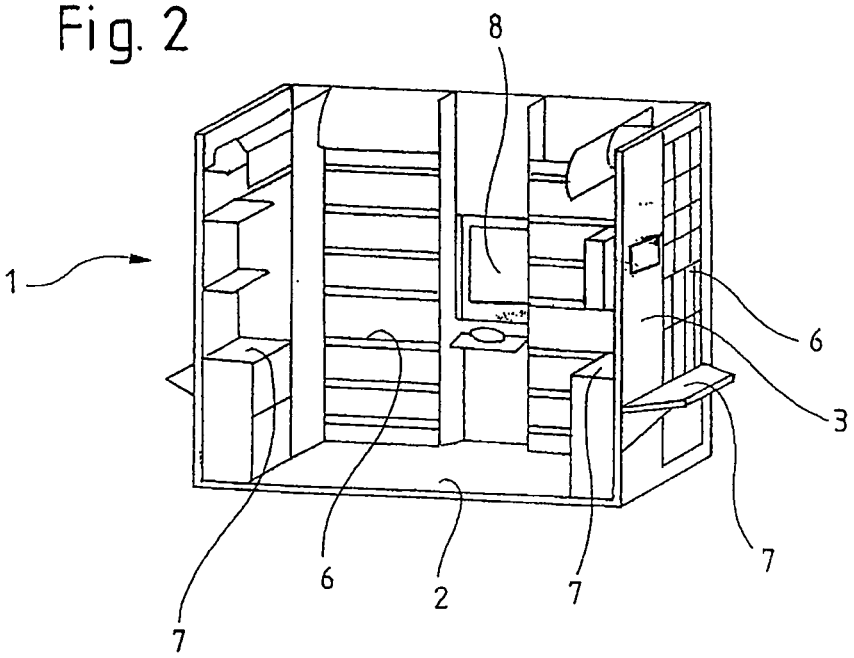
FIG. 2 shows an inside view of the paint mixing room according to FIG. 1.

FIG. 2 shows an inside view of the paint mixing room 1 according to FIG. 1. The inside of the paint mixing room 1 comprises several shelves 6, particularly for water-borne products, solvent-borne products with mixing heads and paddles and/or color tools; two workbenches 7; and a color station 8 comprising e.g. a personal computer, a spectrophotometer, and a barcode reader. The paint mixing room 1 is fully constructed and equipped prior to delivery. Hence, all necessary items for mixing a paint formulation are contained inside the paint mixing room 1. Once the paint mixing room 1 has been transported to a customer, the presentation of the products can start directly after the paint mixing room 1 has been connected to a power supply.

Preferably, the inside of the paint mixing room 1 is air-conditioned and has built in air-extraction via the ventilation system 11.

Reference Numerals

1 paint mixing room
2 base portion
3 wall
4 top portion
5 door
6 shelf
7 workbench
8 color station
9 window
11 ventilation

What is claimed is:

1. A paint mixing room for mixing water-borne or solvent-borne paint products comprising:

a base portion, four sidewalls, a top portion and at least one door located in one of the sidewalls;

at least one shelf for supporting water-borne paint products or solvent-borne paint products and paint mixing equipment;

at least one workbench;

a color station comprising a personal computer, a spectrophotometer, and a barcode reader;

a connector for an electrical power supply; and a ventilation system for removing vapors from the paint mixing room during mixing of the water-borne or solvent-borne paint products by the paint mixing equipment, wherein the paint mixing room is portable.

2. The paint mixing room according to claim 1, wherein the paint mixing room comprises a build and size for transport via a trailer.

3. The paint mixing room according to claim 2, wherein the paint mixing room is at most 6 m long, 4 m wide and 3 m high.

4. The paint mixing room according to claim 1, wherein one of the sidewalls comprises at least one window.

5. The paint mixing room according to claim 4, wherein at least 50% of the surface area of the sidewall comprises window glass.

6. The paint mixing room according to claim 1, wherein the paint mixing room is fully constructed and equipped prior to delivery.

7. The paint mixing room according to claim 1, wherein an exterior side of one of the sidewalls of the paint mixing room further comprises:

at least one shelf and at least one workbench.

8. The paint mixing room according to claim 1, wherein one of the sidewalls comprises at least one door and further comprises at least one window.

* * * * *